US005876136A

United States Patent [19]

Tsutsumi et al.

[11] Patent Number: 5,876,136

[45] Date of Patent: Mar. 2, 1999

[54] WRITING INSTRUMENT WITH BRUSH

[75] Inventors: Toshio Tsutsumi, Chiba; Kazuya Nakagawa, Saitama, both of Japan

[73] Assignee: Platinum Pen Co., Ltd., Tokyo, Japan

[21] Appl. No.: 967,818

[22] Filed: Nov. 12, 1997

[30] Foreign Application Priority Data

Feb. 21, 1997 [JP] Japan ..... 9-001420 U

[51] Int. Cl.[6] ..... B43K 29/00

[52] U.S. Cl. ..... 401/52; 15/1.52; 15/105

[58] Field of Search ..... 401/52, 195, 65, 401/99; 15/1.52, 105, 201, 429, 434

[56] References Cited

U.S. PATENT DOCUMENTS

| | | | |
|---|---|---|---|
| 1,218,948 | 3/1917 | Markley | 401/195 |
| 1,386,635 | 8/1921 | Kubik | 401/52 |
| 4,904,101 | 2/1990 | Petterson | 401/52 |
| 5,056,179 | 10/1991 | Capponi | 15/105 |
| 5,207,522 | 5/1993 | Kageyama et al. | 401/52 |
| 5,662,425 | 9/1997 | Mitsuya | 401/52 |

FOREIGN PATENT DOCUMENTS

| | | | |
|---|---|---|---|
| 5-20553 | 5/1993 | Japan . | |
| 5-28073 | 7/1993 | Japan . | |
| 274330 | 7/1927 | United Kingdom | 15/105 |

*Primary Examiner*—Charles R. Eloshway

*Attorney, Agent, or Firm*—Evenson, McKeown, Edwards & Lenahan, P.L.L.C.

[57] ABSTRACT

A writing instrument such as a mechanical pencil is provided with a brush for eliminating static electricity. The instrument is composed of a barrel and a barrel cap attached to the barrel. A base portion of the brush is fixedly received in a cylindrical protector arranged within the barrel cap. A writing element operating mechanism is arranged to operably hold a writing element such as a lead so that the writing element can be selectively extended from and retracted into the barrel. A brush operating mechanism is also arranged to hold the protector movably along a central axis of the barrel cap so that the brush can be selectively extended from and retracted into the barrel cap. A cylindrical member may preferably be fixedly secured in a rear end of the barrel cap to guide the brush. One of the operating mechanisms can be actuated by causing one of the barrel and the barrel cap to move relative to the other in an axial direction, and the other operating mechanism can be actuated by causing one of the barrel and the barrel cap to turn relative to the other.

7 Claims, 6 Drawing Sheets

WRITING INSTRUMENT WITH BRUSH

BACKGROUND OF THE INVENTION a) Field of the Invention

This invention relates to improvements in a writing instrument equipped with a brush especially for eliminating static electricity.

b) Description of the Related Art

Conventional writing instruments with writing elements arranged therein for selective extension and retraction include those provided at rear end portions thereof with dust cleaning brushes for paper sheets and the like. In particular, there are writing instruments equipped, as such brushes, with brushes for eliminating static electricity. There are also writing instruments in which writing elements can be selectively extended or retracted by causing barrels to turn or slide.

When a barrel cap arranged in fitting engagement with a barrel is turned or pushed down relative to the barrel to extend or retract a brush from or into the barrel, the brush normally accommodated in the barrel cap may be caught at a free end thereof in an opening of the barrel cap or in a guide groove formed on an inner wall of the barrel cap so that the brush may not be smoothly extended or retracted or in some extreme cases, may no longer be extended or retracted. To avoid such drawbacks, it may be contemplated to always leave the brush exposed outside. In this case, the brush is prone to fouling and the appearance is not attractive. It is therefore desired to keep the brush held within the barrel cap while the brush is not used. Because of the above-mentioned drawbacks, however, smooth operability is not fully expected for the brush.

SUMMARY OF THE INVENTION

An object of the present invention is therefore to reduce the above-described drawbacks of the conventional art and to facilitate extensions and retractions of a brush by a simple construction.

In one aspect of the present invention, there is thus provided a writing instrument with a brush for eliminating static electricity, said brush being composed of a bundle of antistatic fibers, comprising:

- a barrel defining front and rear end openings at front and rear ends thereof, respectively, and accommodating a writing element therein;
- a barrel cap defining front and rear end openings at front and rear ends thereof, respectively, and attached at the front end thereof to the rear end of the barrel;
- a cylindrical protector with a base portion of the brush fixedly received therein, said cylindrical protector being arranged within the barrel cap;
- a writing element operating mechanism for operably holding the writing element so that the writing element can be selectively extended from and retracted into the barrel through the front end opening of the barrel; and
- a brush operating mechanism for holding the cylindrical protector movably along a central axis of the barrel cap so that the brush can be selectively extended from and retracted into the barrel cap through the rear end opening of the barrel cap.

The writing instrument may further comprises:

- a cylindrical member fixedly secured in the rear end opening of the barrel cap to guide the brush.

In another aspect of the present invention, there is also provided a writing instrument with a brush for eliminating static electricity, said brush being composed of a bundle of antistatic fibers, comprising:

- a barrel defining front and rear end openings at front and rear ends thereof, respectively, and accommodating a writing element therein;
- a barrel cap defining front and rear end openings at front and rear ends thereof, respectively, and attached at the front end thereof to the rear end of the barrel;
- a cylindrical member fixedly secured in the rear end opening of the barrel cap to guide the brush;
- a writing element operating mechanism for operably holding the writing element so that the writing element can be selectively extended from and retracted into the barrel through the front end opening of the barrel; and
- a brush operating mechanism for operably holding the brush so that the brush can be selectively extended from and retracted into the barrel cap through the rear end opening of the barrel cap.

The writing element operating mechanism may be actuated by causing one of the barrel and the barrel cap to move relative to the other in an axial direction; and the brush operating mechanism may be actuated by causing one of the barrel and the barrel cap to turn relative to the other.

The operation for the selective extension and retraction of the writing element and that for the selective extension and retraction of the brush are therefore different in direction. This has brought about an advantage that an extension or retraction of the writing element and that of the brush can be performed independently from each other. Further, the arrangement of the cylindrical member and/or cylindrical protector has brought about another advantage that the brush can be smoothly exposed while preventing it from being caught up, thereby allowing the writing instrument to exhibit sufficient de-electrification, i.e., electricity eliminating effects.

DETAILED DESCRIPTION OF THE INVENTION AND PREFERRED EMBODIMENT

Figure 1:
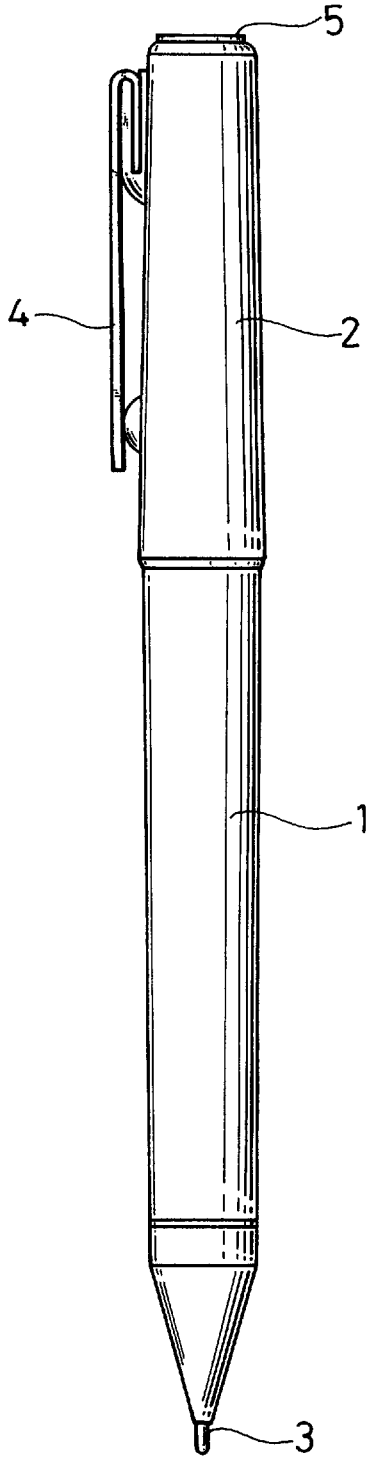
FIG. 1 is a front view of a writing instrument according to one embodiment of the present invention.
Figure 2:
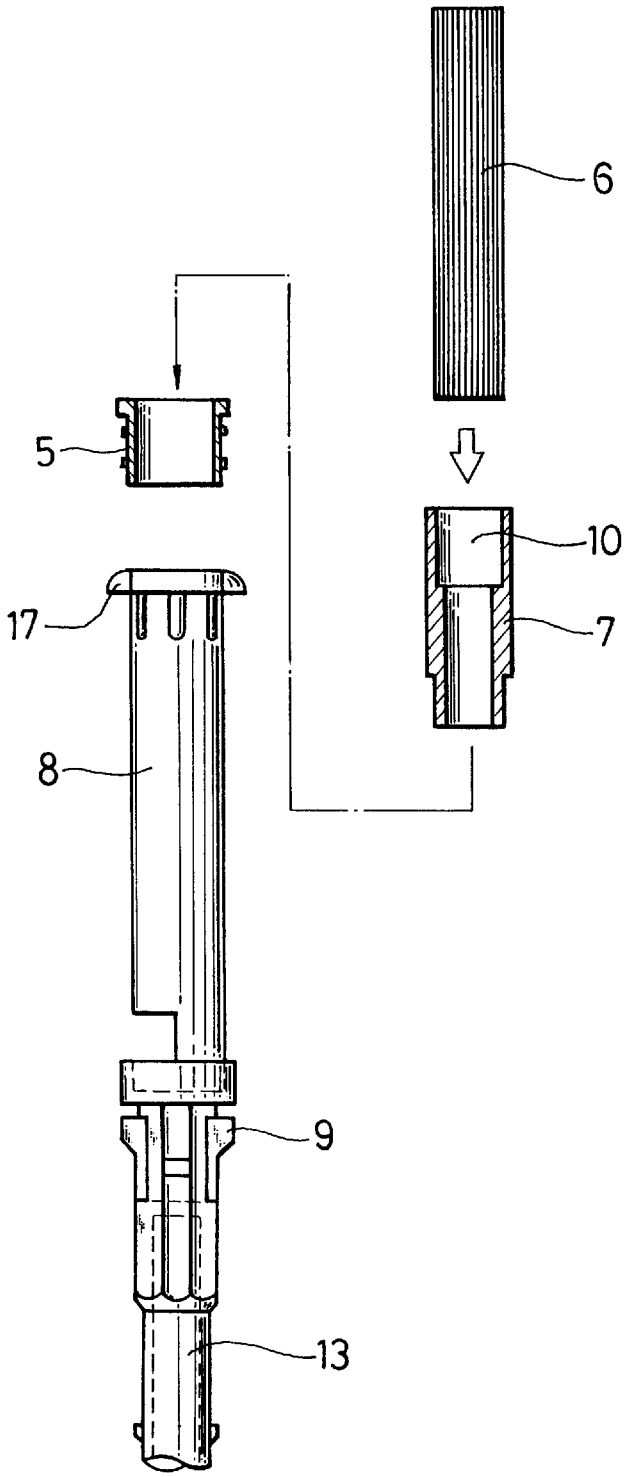
FIG. 2 is an exploded, partly cross-sectional, fragmentary view of the writing instrument according to the one embodiment of the present invention as taken out of a barrel and a barrel cap.

The present invention will hereinafter be described in further detail on the basis of the embodiment illustrated in the accompanying drawings.

Numeral 1 indicates a barrel through a front end thereof a writing element 3—for example, a lead of a mechanical pencil—is extended or retracted. A barrel cap 2, which is fitted on a rear end of the barrel 1, is moved in an axial direction relative to the barrel 1, whereby by a chuck (not shown) disposed within the barrel 1, the writing element 3 is extended out through the front end and is held in the extended position to permit writing. A brush-extending cylinder 8 is connected to a writing element pushdown mechanism 13. An engaging flange 17 is arranged at a rear end of the brush-extending cylinder 8, and is in engagement with a rear end opening 16 of the barrel cap 2. Accordingly, the brush-extending cylinder 8 is integrally connected to the barrel cap (2) via the writing element pushdown mechanism 13 and the brush-extending cylinder 8.

Optionally, a clip 4 may be attached to the barrel cap 2 so that the writing instrument can be fastened to a breast pocket or the like. The brush-extending cylinder 8 accommodated within the barrel cap 2 is moved toward the rear end opening 16 of the barrel cap 2 as will be described next. Internal threads are formed on a peripheral inner wall of the brush-extending cylinder 8. A slider 12 is provided with engaging projections 14, which are in engagement with the internal threads. When the barrel cap 2 is turned, the slider 12 is caused to move toward the rear end opening 16 of the barrel cap 2 along a guide groove 11 formed in an axial direction of the brush-extending cylinder 8. A cylindrical protector 7 is provided with a receiving portion 10, in which the brush 6 is fixedly received at a base portion thereof. The cylindrical protector 7 is fitted in the slider 12 and is maintained in engagement with the peripheral inner wall of the brush-extending cylinder 8 via an engaging ring 15. Even when a great majority of the brush 6 is exposed through the rear end of the barrel cap 2, the cylindrical protector 7 which holds the base portion of the brush 6 still remains inside the barrel cap 2 to protect the brush 6. The engaging ring 15 remains in contact at an outer periphery thereof with the peripheral inner wall of the brush-extending cylinder 8, and serves to smoothly guide the cylindrical protector 7 together with the brush 6 within the brush-extending cylinder 8.

Figure 3:
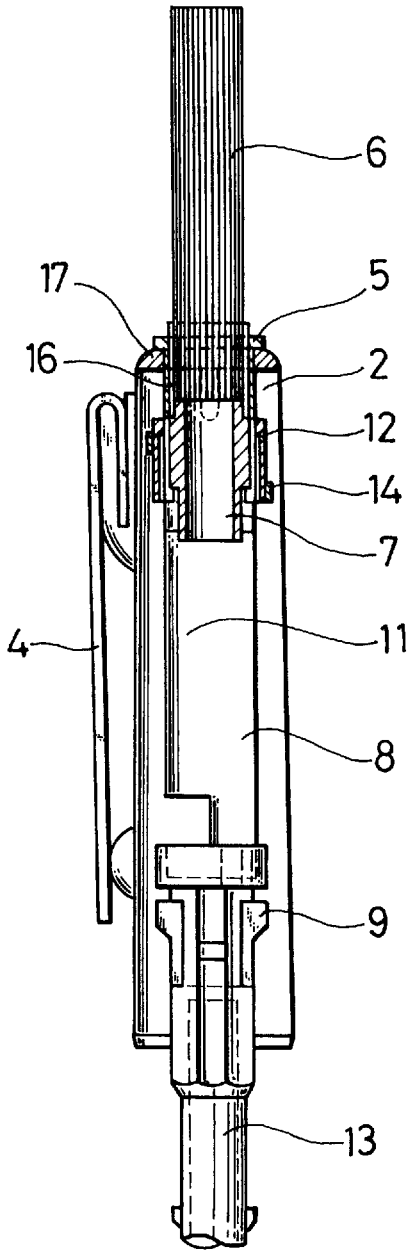
FIG. 3 is a fragmentary cross-sectional view of the writing instrument according to the one embodiment of the present invention, in which a brush has been exposed from the barrel cap.
Figure 4:
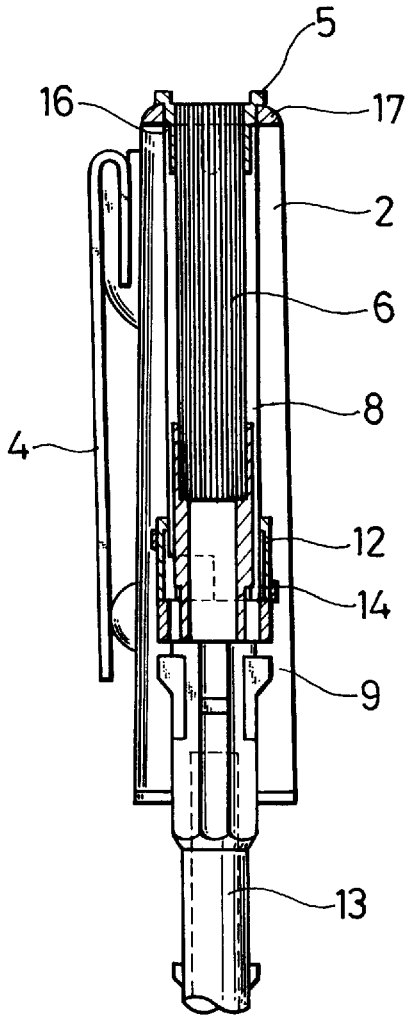
FIG. 4 is similar to FIG. 3 except that the brush has been stored within the barrel cap.
Figure 5:
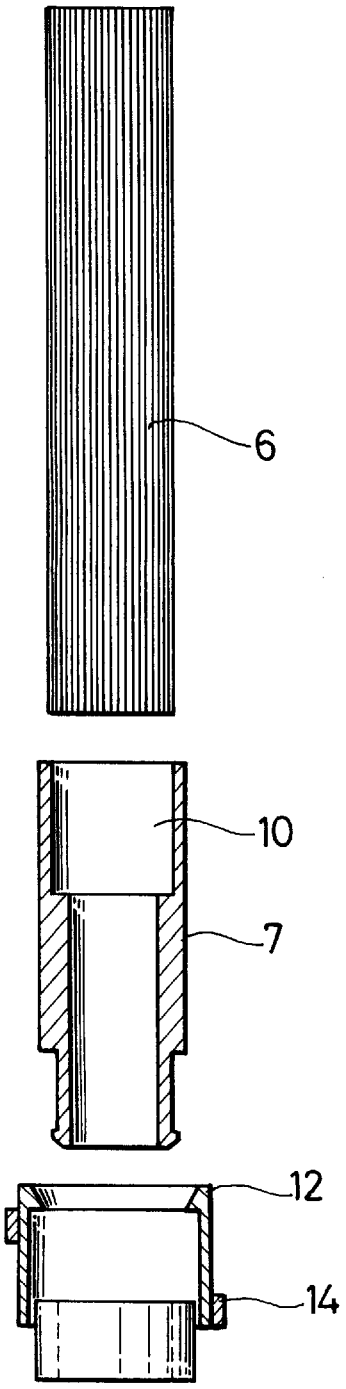
FIG. 5 is an exploded, partly cross-sectional view showing a relationship among the brush, a protector and a slider in the writing instrument according to the one embodiment of the present invention.
Figure 6:
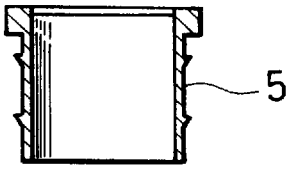
FIG. 6 is a cross-sectional view of a cylindrical member press-fitted in an opening of the barrel cap in the writing instrument according to the one embodiment of the present invention.
Figure 7:
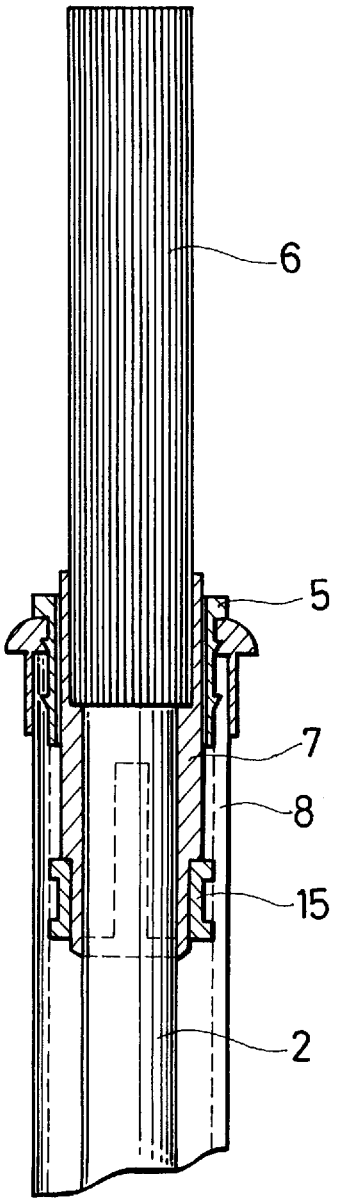
FIG. 7 is a fragmentary cross-sectional view of the writing instrument according to the one embodiment of the present invention, in which a brush operating mechanism is illustrated.

When the brush 6 is stored back into the barrel cap 2 from the exposed position, the base portion of the brush 6 is protected from strong sliding friction. Further, owing to the provision of the cylindrical member 5 press-fitted in the rear opening 16 of the barrel cap 2 (note: this opening is shown in upper parts in FIG. 3 and FIG. 4), the brush 6 is prevented from being caught in the guide groove 11 when the slider 12 is caused to move. This assures smooth exposure of the brush 6, thereby allowing to exhibit sufficient de-electrification effects.

Incidentally, designated at numeral 9 is an extension guide. This extension guide 9 is arranged integrally with the writing element pushdown mechanism 13 and, when the brush-extending cylinder 8 is fittedly inserted together with the writing element pushdown mechanism 13 in the barrel cap 2, the extension guide 9 is located in a lower part of the barrel cap 2 and is brought into engagement with the inner peripheral wall of the barrel cap 2. In this embodiment, the brush 6 is exposed through the rear end opening 16 of the barrel cap 2 by turning the barrel cap 2 relative to the barrel 1. The brush 6 can also be exposed by causing the slider 12 to slide in the axial direction by a finger or the like instead of turning the barrel cap 2. Likewise, a conventional extension mechanism can be arranged to permit extension of the writing element push-down mechanism 13 by turning, as is well known in the art.

Concerning the above-described writing element operating mechanism and brush operating mechanism, conventionally-known mechanism can be used. Reference may be had to the following publications although erasers are used therein instead of brushes: Japanese Utility Model Publication (Kokoku) No. HEI 5-20553 published May 27, 1993 and Japanese Utility Model Publication (Kokoku) No. HEI 5-28073 published Jul. 19, 1993.

The writing instrument according to the one embodiment of the present invention can be used as will be described hereinafter. While holding the barrel 1 in a hand, the barrel cap 2 fitted on the rear end of the barrel 1 is turned. As a result, the brush 6 stored for selective extension and retraction within the barrel cap 2 is mostly exposed. By rubbing a given surface with this brush 6, static electricity on the surface is dissipated through the brush 6 so that de-electrification effects are exhibited. On the other hand, the writing element 3 is extended through the front end of the barrel 1 by moving the barrel cap 2 in the axial direction relative to the barrel 1. To retract the writing element 3 back into the barrel 1 through the front end thereof, the tip of the writing element 3 is pressed against a firm surface such as a desk top or is pushed by a finger while pushing down the barrel cap 2 in the axial direction.

As the brush 6 for eliminating static electricity, it is possible to use, for example, a brush composed of a bundle of acrylonitrile-copper sulfate composite fibers with copper ions confined to acrylic fibers. The base portion of the brush 6 is fixedly received within the cylindrical protector 7. Upon extension of the brush 6 through the rear end opening of the barrel cap 2, the brush 6 is therefore free from the troublesome catch-up by a peripheral edge of the rear end opening of the barrel cap 2 which would otherwise occur through a contact of the base portion of the brush 6 with the peripheral edge.

Further, owing to the cylindrical member 5 fitted in the rear end opening of the barrel cap 2, it is also possible to avoid such a problem that upon storing the brush 6, bristles may spread out from a free end of the brush 6 and caught by the peripheral edge of the rear end opening of the barrel cap 2, thereby making the brush 6 no longer retractable into the barrel cap 2.

In addition, the brush 6 is selectively extended and retracted by a turning operation, while the writing element 3 is selectively extended and retracted by a push-down operation. Hence, the operation for the selective extension and retraction of the writing element 3 and that for the selective extension and retraction of the brush 6 are different in direction. This has made it possible to perform an extension or retraction of the writing element 3 independently from that of the brush 6, and vice versa, thereby assuring the performance of both the operations without failure.

What is claimed is:

1. A writing instrument with a writing element and a brush for eliminating static electricity, said brush being composed of a bundle of antistatic fibers, comprising:

a barrel defining front and rear end openings at front and rear ends thereof, respectively, and accommodating a writing element therein;

a barrel cap defining front and rear end openings at front and rear ends thereof, respectively, and attached at said front end thereof to said rear end of said barrel;

a cylindrical protector with a base portion of said brush fixedly received therein, said cylindrical protector being arranged within said barrel cap;

a writing element operating mechanism for operably holding said writing element so that said writing element can be selectively extended from and retracted into said barrel through said front end opening of said barrel; and a brush operating mechanism for holding said cylindrical protector movably along a central axis of said barrel cap so that said brush can be selectively extended from and retracted into said barrel cap through said rear end opening of said barrel cap.

2. The writing instrument according to claim 1, wherein:

said writing element operating mechanism is actuated by causing one of said barrel and said barrel cap to move relative to the other in an axial direction; and said brush operating mechanism is actuated by causing one of said barrel and said barrel cap to turn relative to the other.

3. The writing instrument according to claim 2, further comprising:

a cylindrical member fixedly secured in said rear end opening of said barrel cap to guide said brush.

4. The writing instrument according to claim 1, wherein:

said writing element operating mechanism is actuated by causing one of said barrel and said barrel cap to turn relative to the other; and said brush operating mechanism is actuated by causing one of said barrel and said barrel cap to move relative to the other in an axial direction.

5. A writing instrument with a a writing element and brush for eliminating static electricity, said brush being composed of a bundle of antistatic fibers, comprising:

a barrel defining front and rear end openings at front and rear ends thereof, respectively, and accommodating a writing element therein;

a barrel cap defining front and rear end openings at front and rear ends thereof, respectively, and attached at said front end thereof to said rear end of said barrel;

a cylindrical member fixedly secured in said rear end opening of said barrel cap to guide said brush;

a writing element operating mechanism for operably holding said writing element so that said writing element can be selectively extended from and retracted into said barrel through said front end opening of said barrel; and a brush operating mechanism for operably holding said brush so that said brush can be selectively extended from and retracted into said barrel cap through said rear end opening of said barrel cap.

6. The writing instrument according to claim 5, wherein:

said writing element operating mechanism is actuated by causing one of said barrel and said barrel cap to move relative to the other in an axial direction; and said brush operating mechanism is actuated by causing one of said barrel and said barrel cap to turn relative to the other.

7. The writing instrument according to claim 5, wherein:

said writing element operating mechanism is actuated by causing one of said barrel and said barrel cap to turn relative to the other; and said brush operating mechanism is actuated by causing one of said barrel and said barrel cap to move relative to the other in an axial direction.

* * * * *